US006062820A

United States Patent [19]

Wang

[11] Patent Number: 6,062,820

[45] Date of Patent: May 16, 2000

[54] STRUCTURE FOR MOUNTING BLADES OF A CEILING FAN

[76] Inventor: Chun-Ming Wang, P.O. Box 82-144, Taipei, Taiwan

[21] Appl. No.: 09/201,707

[22] Filed: Dec. 1, 1998

[51] Int. Cl.[7] ..... B63H 1/20

[52] U.S. Cl. ..... 416/210 R; 416/204 R; 416/244 R; 416/219 A; 416/220 A

[58] Field of Search ..... 416/5, 204 R, 416/210 R, 219 A, 220 A, 244 R

[56] References Cited

U.S. PATENT DOCUMENTS 5,927,945 9/1999 Chen ..... 416/5
5,951,197 9/1999 Wu ..... 403/315

*Primary Examiner*—Edward K. Look
*Assistant Examiner*—Ninh Nguyen
*Attorney, Agent, or Firm*—A & J

[57] ABSTRACT

An improvement in the structure for mounting blades of a ceiling fan, characterized in that a motor comprising a bottom formed with a plurality of threaded holes, an annular ring-like mounting secured to the bottom of the electric motor by screws and provided with a plurality of brackets each having a groove which gradually decreases in size from an upper portion toward an lower portion thereof, each of the blades provided with a rod having a tongue which gradually decreases in size from an upper end to an lower end thereof, the tongue being configured so that the upper end of the tongue has same size of the upper portion of the groove while the lower end of the tongue has same size of the lower portion of the groove thereby enabling the tongue to fit into the groove but not slide out thereof.

1 Claim, 5 Drawing Sheets

STRUCTURE FOR MOUNTING BLADES OF A CEILING FAN

BACKGROUND OF THE INVENTION

1. Field of the Invention

This invention is related to a structure for mounting blades of a ceiling fan and in particular to one which enables the blades to be easily mounted on and dismounted from a ceiling fan.

2. Description of the Prior Art

With reference to FIG. 1, the conventional blade 14 of a ceiling fan has a rod member 11 which has a curved bracket 111 at the outer end. The curved bracket 111 is secured to the bottom of an electric motor 13 by a plurality of screws 12. However, the blade 14 will be very difficult to be dismantled from the electric motor 14 once fastened thereby making it very inconvenient to clean the blade 14.

Therefore, it is an object of the present invention to provide an improved structure for mounting blades of a ceiling fan which can obviate and mitigate the above-mentioned drawbacks.

SUMMARY OF THE INVENTION

This invention is related to an improved structure for mounting blades of a ceiling fan.

It is the primary object of the present invention to provide an improved structure for mounting blades of a ceiling fan which enables the blade from being dismantled from the ceiling fan without any tools.

It is another object of the present invention to provide an improved structure for mounting blades of a ceiling fan which enables the blade from being easily dismantled from the ceiling fan as required.

It is still another object of the present invention to provide an improved structure for mounting blades of a ceiling fan which is simple in construction.

It is still another object of the present invention to provide an improved structure for mounting blades of a ceiling fan which is facile to manufacture.

It is a further object of the present invention to provide an improved structure for mounting blades of a ceiling fan which is fit for practical use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

BRIEF DESCRIPTION OF THE DRAWINGS

These and other features of the present invention and the attendant advantages will be readily apparaent to those having ordinary skill in art and the invention will be more easily understood from the following detailed description of the preferred embodiment of the present invention taken in conjunction with the accompanying drawings wherein like reference characters represent like parts throughout the views, and wherein.

DETAILED DESCRIPTION OF THE PREFERRED EMBODIMENT

Figure 1:
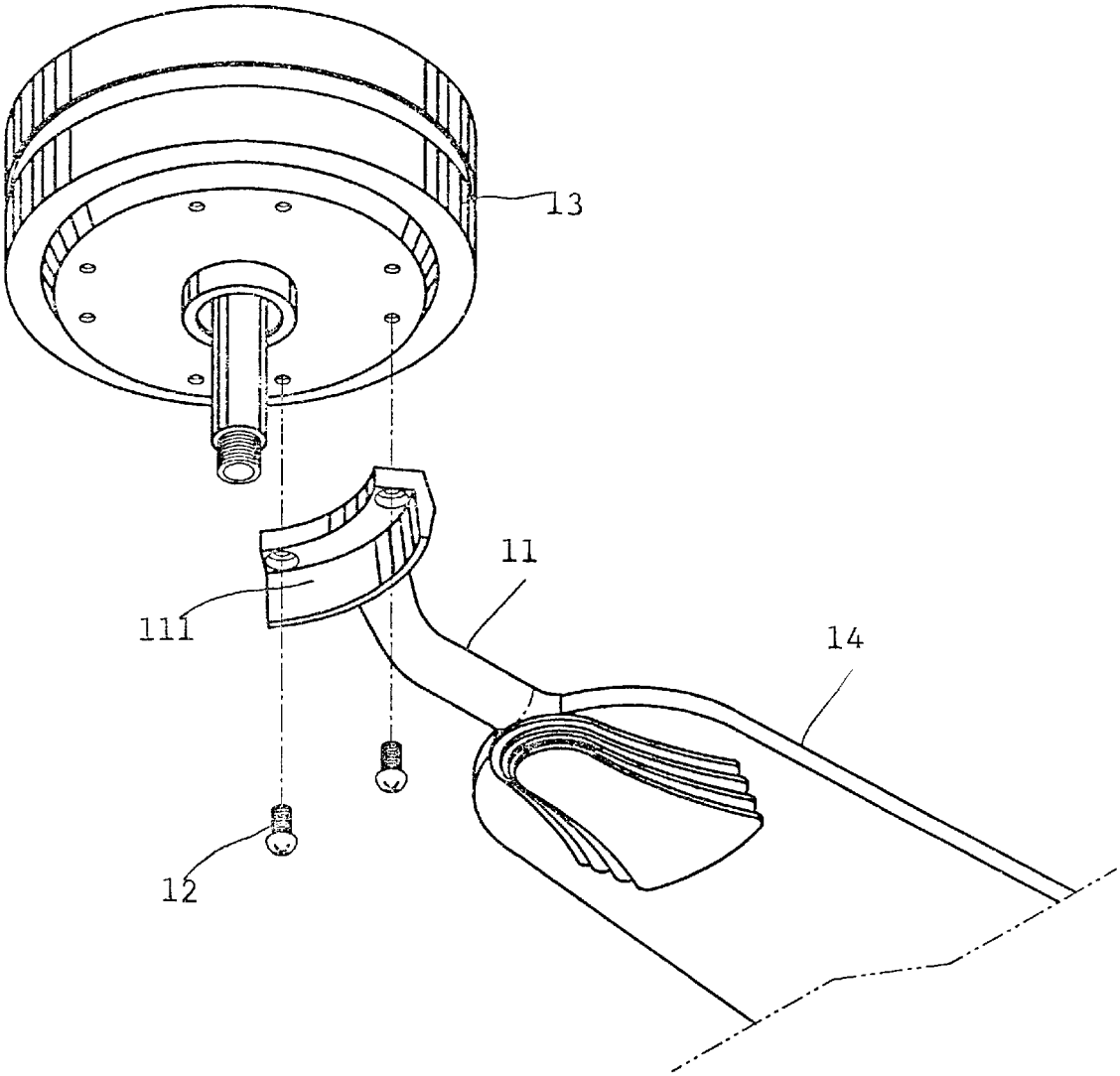
PRIOR ART FIG. 1
FIG. 1 illustrates a prior art structure for mounting a blade of a ceiling fan.
Figure 2:
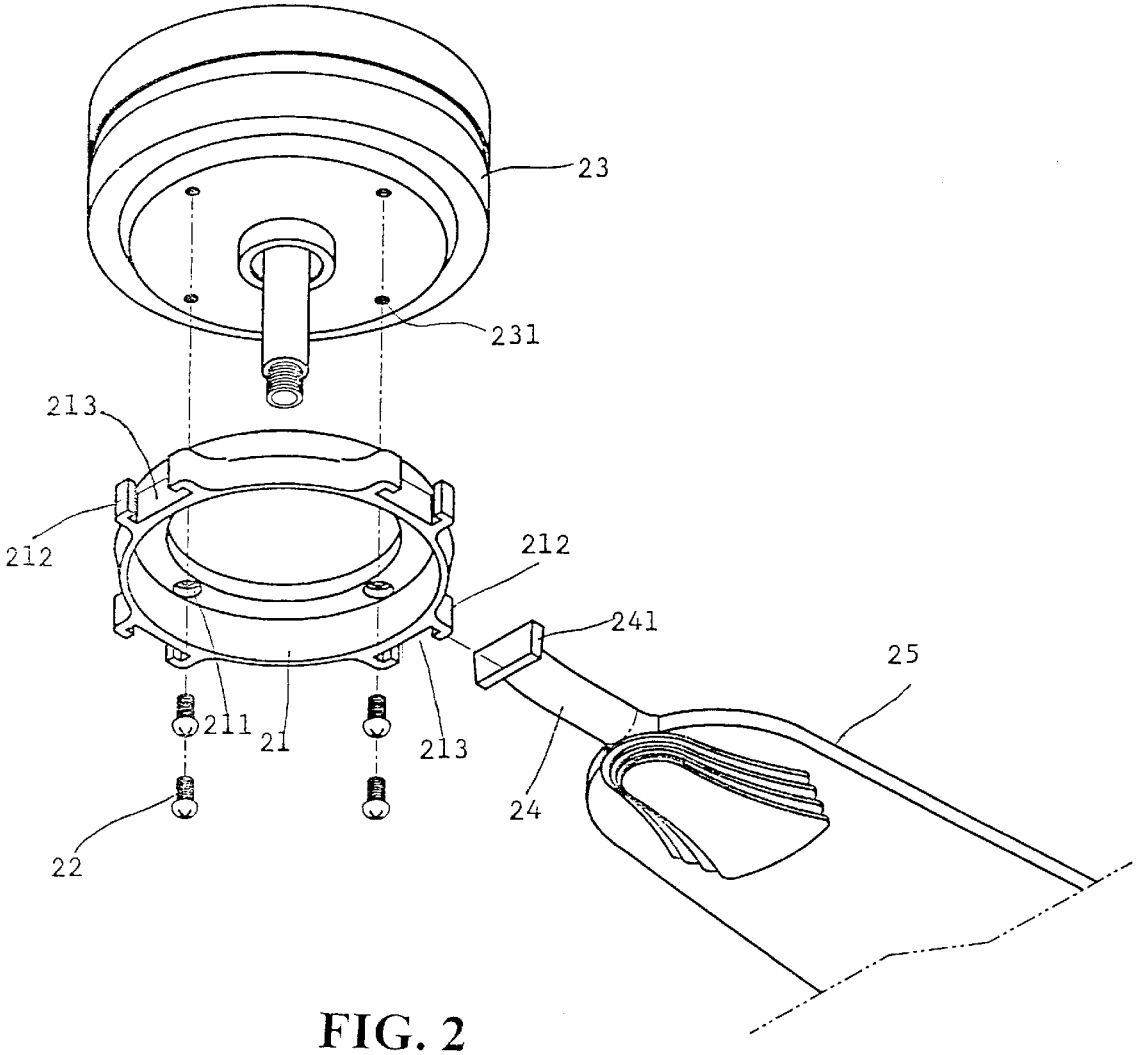
FIG. 2 is an exploded view of the present invention.
Figure 3:
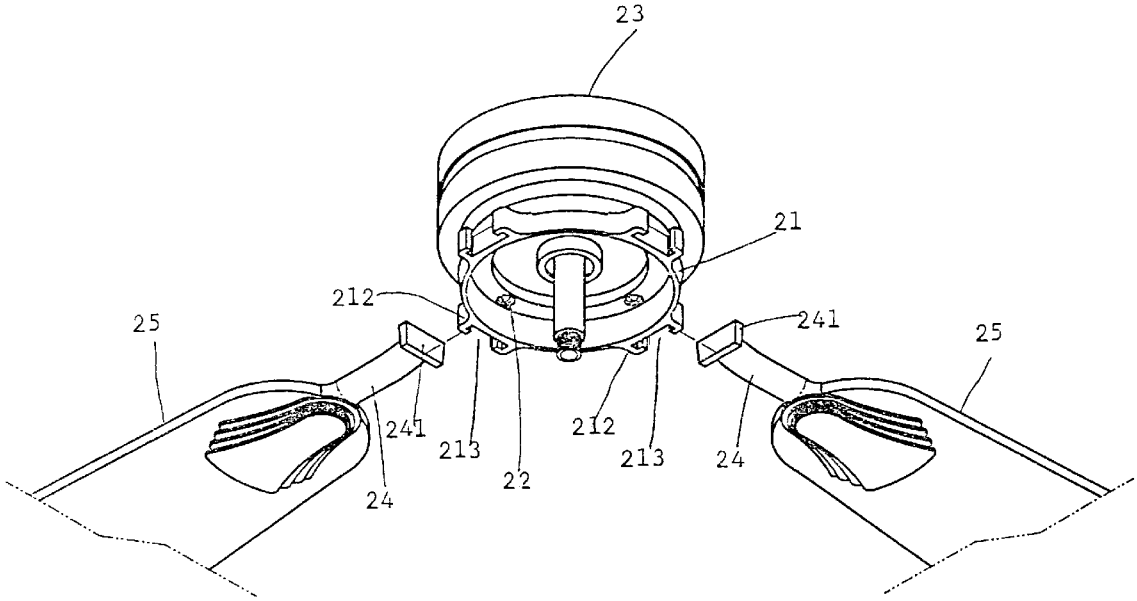
FIGS. 3 and 4 illustrate how to secure the blades to the electric motor.

With reference to the drawings and in particular to FIGS. 2 and 3 thereof, the present invention comprises an electric motor 23 having a bottom formed with a plurality of threaded holes 231 and a plurality of blades 25 secured to the bottom of the electric motor 23.

An annular ring-like mounting 21 having a plurality of holes 211 is fixedly mounted on the bottom of the electric motor 23 by screws 22 extending through the hole 211 of the annular ring-like mounting 21 into the threaded holes 231 of the electric motor 23. The outer side of the annular ring-like mounting 21 is provided with a plurality of equidistant brackets 212 each having a groove 213 which gradually decreases in size from the upper end toward the lower end.

The blade 25 is provided with a rod 24 having a tongue 241 which gradually decreases in size from the upper end to the lower end. The tongue 241 is configured so that the upper end of the tongue 241 has the same size of the upper portion of the groove 213 while the lower end of the tongue 241 has the same size of the lower portion of the groove 213. Hence, the tongue 241 can fit into the groove 213 of the bracket 212, but not slide out thereof.

Figure 4:
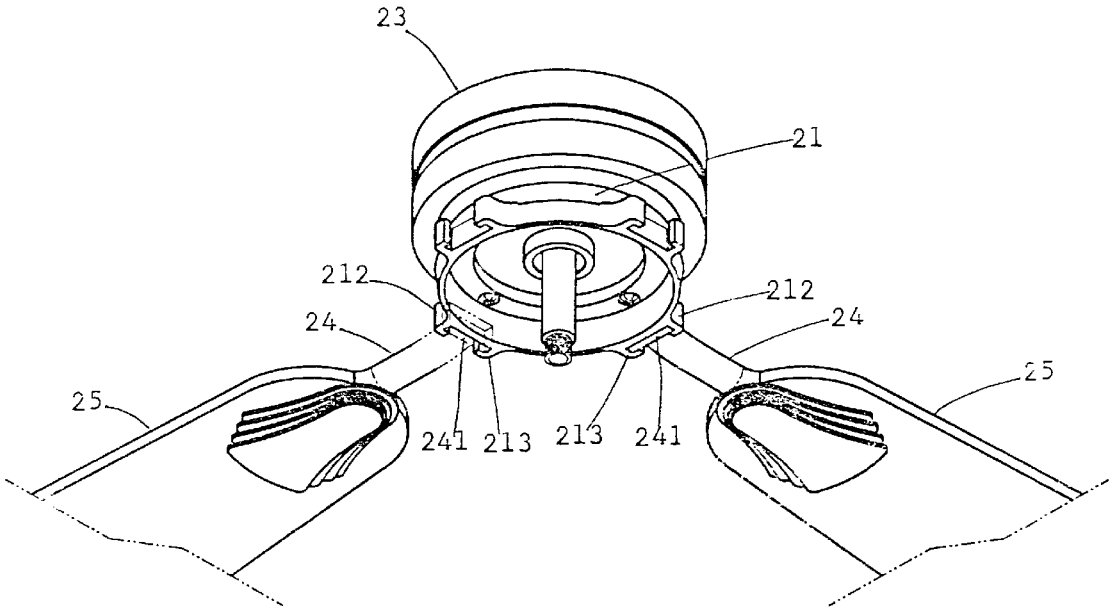
Figure 5:
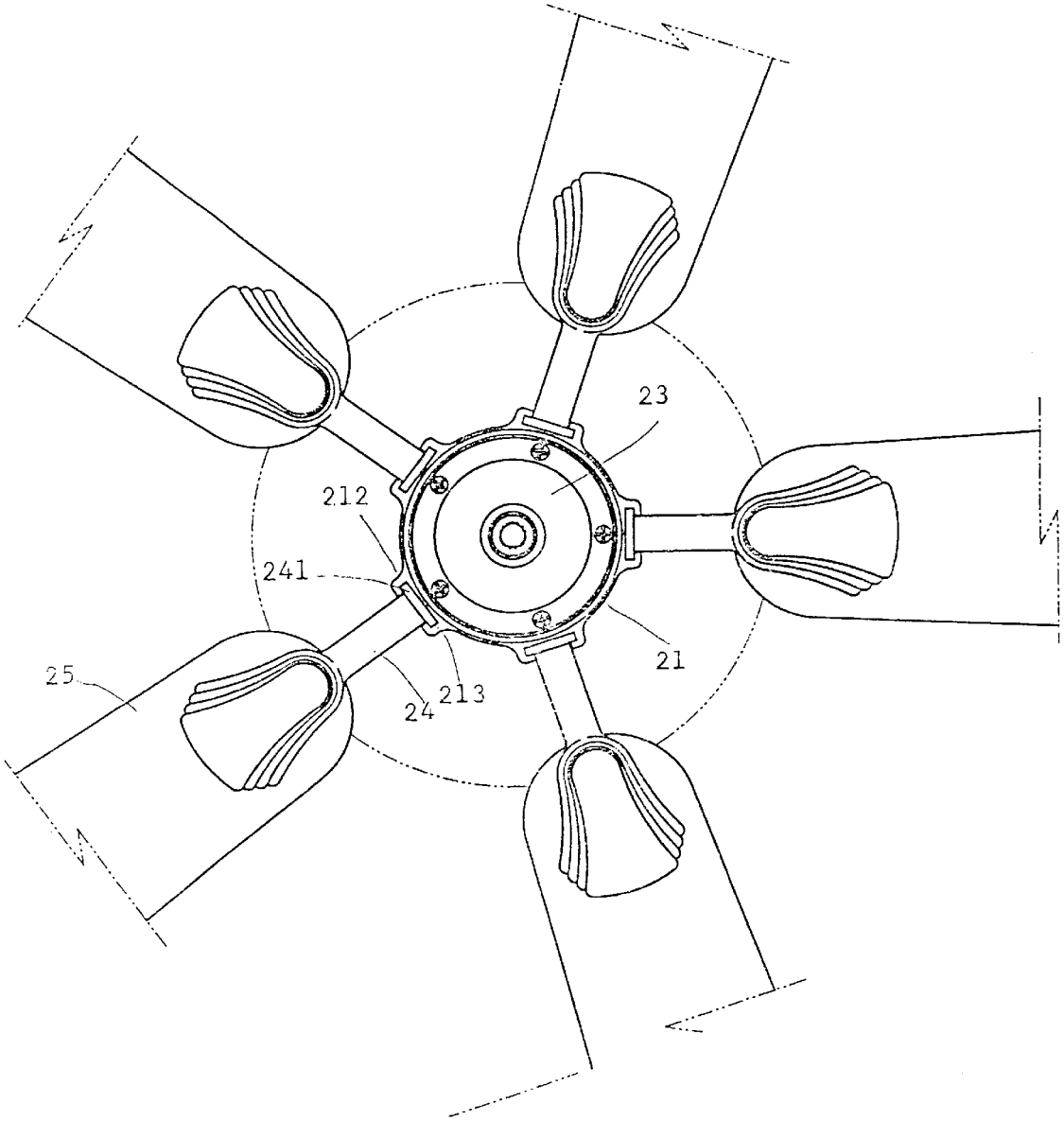
FIG. 5 is a bottom view of the present invention.

The assembly of the present invention is shown in FIGS. 3, 4 and 5. The annular ring-like mounting 21 is fixedly secured to the bottom of the electric motor 23 in manufacture. Thus, when in assembly, it is only necessary to fit the tongue 241 of the blade 25 into the groove 213 of the annular ring-like mounting 21. When desired, the blade 25 can be easily disengaged from the annular ring-like mounting 21 for cleaning purpose.

The invention is naturally not limited in any sense to the particular features specified in the foregoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. In a ceiling fan provided with a plurality of blades and an electric motor, said motor comprising a bottom formed with a plurality of threaded holes, an annular ring-like mounting secured to said bottom of said electric motor by screws and provided with a plurality of brackets each having a groove which gradually decreases in size from an upper portion toward an lower portion thereof, each of said blades provided with a rod having a tongue which gradually decreases in size from an upper end to an lower end thereof, said tongue being configured so that said upper end of said tongue has same size of said upper portion of said groove while said lower end of said tongue has same size of said lower portion of said groove thereby enabling said tongue to fit into said groove but not slide out thereof.

* * * * *